US005873338A

United States Patent [19]

Matsubara et al.

[11] Patent Number: 5,873,338

[45] Date of Patent: Feb. 23, 1999

[54] SPARK PLUG FOR AN INTERNAL COMBUSTION ENGINE

[75] Inventors: Yoshihiro Matsubara; Tetsushi Suzuki; Yuuji Hirano; Kazuya Iwata, all of Nagoya, Japan

[73] Assignee: NGK Spark Plug Co., Ltd., Nagoya, Japan

[21] Appl. No.: 870,907

[22] Filed: Jun. 6, 1997

[30] Foreign Application Priority Data

Jun. 7, 1996 [JP] Japan ..... 8-146270

[51] Int. Cl.[6] ..... H01T 13/20

[52] U.S. Cl. ..... 123/169 EL; 123/169 MG; 313/140; 313/141

[58] Field of Search ..... 123/169 R, 169 EL, 123/169 MG; 313/141, 142, 143, 140

[56] References Cited

U.S. PATENT DOCUMENTS

| | | | |
|---|---|---|---|
| 2,899,479 | 8/1959 | Atwell et al. | 123/169 R |
| 4,540,912 | 9/1985 | Matesco | 313/142 |
| 4,748,947 | 6/1988 | LoRusso et al. | 123/145 A |
| 4,774,914 | 10/1988 | Ward | 123/169 EL X |
| 4,841,925 | 6/1989 | Ward | 123/169 EL X |
| 5,731,654 | 3/1998 | Benedikt et al. | 313/141 X |

FOREIGN PATENT DOCUMENTS

| | | |
|---|---|---|
| 89 08 502.7 | 9/1989 | Germany . |
| 1-302678 | 12/1989 | Japan . |

OTHER PUBLICATIONS

"Patent Abstracts of Japan", vol. 009, No. 305 (E–363), abstract of JP–60–143549, Dec. 1985.

*Primary Examiner*—Tony M. Argenbright
*Attorney, Agent, or Firm*—Sughrue, Mion, Zinn, Macpeak & Seas, PLLC

[57] ABSTRACT

A spark plug has a cylindrical metal shell, a ground electrode and an insulator fixedly supported within the metal shell with a front end of the insulator extended beyond a front end of the metal shell. The insulator has an axial bore in which a center electrode is placed to form a spark gap with the ground electrode. The front end of the metal shell is generally flush with or somewhat recessed into an inner wall of a combustion chamber of an internal combustion engine when the spark plug is mounted on a cylinder head of the engine. The front end of the insulator extends at least 4.0 mm from the front end of the metal shell.

9 Claims, 10 Drawing Sheets

SPARK PLUG FOR AN INTERNAL COMBUSTION ENGINE

BACKGROUND OF THE INVENTION

1. Field of the Invention

The invention relates to a spark plug which is improved to optimally located a firng portion within a combustion chamber upon mounting the spark plug on a cylinder head of an internal combustion engine.

2. Description of Prior Art

In recent years, a lean burn type engine and high output engine have been introduced chiefly with an aim to obtaining a high efficiency. In these types of the engines, when an air-fuel mixture injected into a combustion chamber is ignited by a spark plug, it often burns in laminar form because a density distribution of the air-fuel mixture greatly varies within the combustion chamber. In order to cope with the situation, it is necessary to determine where a firing portion of the spark plug is to be optimally located within the combustion chamber. On the other hand, due to the air-fuel mixture thickly concentrated around the firing portion of the spark plug, the carbon fouling is likely to deposit on a front end of an insulator.

In order to improve the carbon fouling resistance, a published Japanese application No. 5-46673 discloses a spark plug in which carbon deposit is burningly removed by thinning a front end of an insulator nose in order to quicken its temperature rise with a minimum heat capacity.

In each of a laying-open Japanese application No. 60-235379, published Japanese application No. 3-41951 and published Japanese application No. 56-47915, a spark plug is disclosed to improve the carbon fouling resistance and heat resistant property by mainly determining an extension length protracted from an inner wall of the combustion chamber to a front end of a center electrode.

However, it is found that these types of the spark plugs have a enough room for further improvement from the points of the carbon fouling resistance and heat resistant property as a result of carrying out an experimetal test with the above prior art spark plugs mounted respectively on the high efficient engine.

Therefore, it is a main object of the invention to provide a spark plug which is capable of obtaining a good carbon fouling resistance without sacrificing a favorable ignitability when mounted on an internal combustion engine which tends to carbon smolder an insulator.

SUMMARY OF THE INVENTION

According to the present invention, the front end of the metal shell is adapted to be substantially in flush with or slightly inward into an inner wall of a combustion chamber of an internal combustion engine when the spark plug is mounted on a cylinder head of the internal combustion engine, and the front end of the insulator extending at least 4.0 mm from the front end of the metal shell. This makes it possible to set a firing portion in an optimal position so as to improve an ignitability. From the reason that a front end of the insulator is satisfactorily heated, it is possible to burn away the carbon deposit so as to improve the carbon fouling resistant property.

According to another aspect of the present invention, an insulator whose front end includes an equally diameter-reduced portion is fixedly supported within the metal shell with the front end of the insulator extended beyond a front end of a metal shell. Further, the front end of the metal shell is adapted to be substantially in flush with or somewhat inward into an inner wall of a combustion chamber of an internal combustion engine when the spark plug is mounted on a cylinder head of the internal combustion engine, and the front end including the equally diameter-reduced portion of the insulator extending at least 4.0 mm from the front end of the metal shell. This makes it possible to set the firing portion in the optimal position so as to improve the ignitability.

When running the engine at a low heat, load, the front end of the insulator accompanies a quick temperature rise to burn away the carbon deposit so as to substantially ameliorate the carbon fouling resistance. When running the engine at a high heat load, due to a thinned front end of the insulator, it is efficiently cooled by streams of the air-fuel mixture injected Into the combustion chamber so as to ameliorate the heat resistant property significantly.

According to other aspect of the present invention, the equally diameter-reduced portion of the insulator is more than 1.0 mm in length, but less than 1.5 mm in thickness. When the length of the equally diameter-reduced portion is more than 1.0 mm, it is possible to maintain a high temperature at the front end of the insulator when running the engine at the low heat load. When the thickness of the equally diameter-reduced portion is less than 1.5 mm, it is possible to efficiently cool the front end of the insulator when running the engine at the high heat load.

According to other aspect of the present invention, an outer surface of the metal shell has a threaded portion whose diameter is 14 mm, and the insulator has an insulator nose whose length is more than 14 mm. Since a lengthened insulator nose has a significantly small affect on the heat resistance reduction in an extension type spark plug, it is possible to ensure a good carbon fouling resistance by determining the insulator nose length to be more than 14 mm when the diameter of the threaded portion is 14 mm.

According to other aspect of the present invention, the metal shell has a cylindrical extension end which extends by more than 1.5 mm from the inner wall of the combustion chamber toward the central area of the combustion chamber. Due to the insulator nose exposed to the combustion chamber of the internal combustion engine, it is likely to lose an insulation resistance in the extension type spark plug. With the cylindrical extension end which extends by more than 1.5 mm inward from the inner wall of the combustion chamber, it is possible to prevent the insulator nose from losing the insulation resistance.

According to other aspect of the present invention, a semi-surface creeping discharge type spark plug is provided in which the center electrode forms a creeping discharge gap and an air discharge gap with an elevational side of the front end of the insulator so as to release creeping discharges across the creeping discharge gap along a front end surface of the insulator while releasing the spark discharges across the air discharge gap. This makes it possible to burn away the carbon deposit piled on the front end surface of the insulator.

From the reason that the spark discharges occur at the same area when self-cleaning the carbon deposit, it is possible to facilitate the self-cleaning action without losing a good ignitability.

According to other aspect of the present invention, an outer surface of the metal shell has a threaded portion whose diameter is 14 mm, and an inner diameter of the metal shell portion which positions inside of the combustion chamber is less than 8 Mm. This makes it possible to reduce its cubic volume, and thereby mitigating an entry of the carbon smoke into behind the metal shell to substantially avoid the insulation resistance reduction.

DETAILED DESCRIPTION OF PREFERRED EMBODIMENTS OF THE INVENTION

Figure 1:
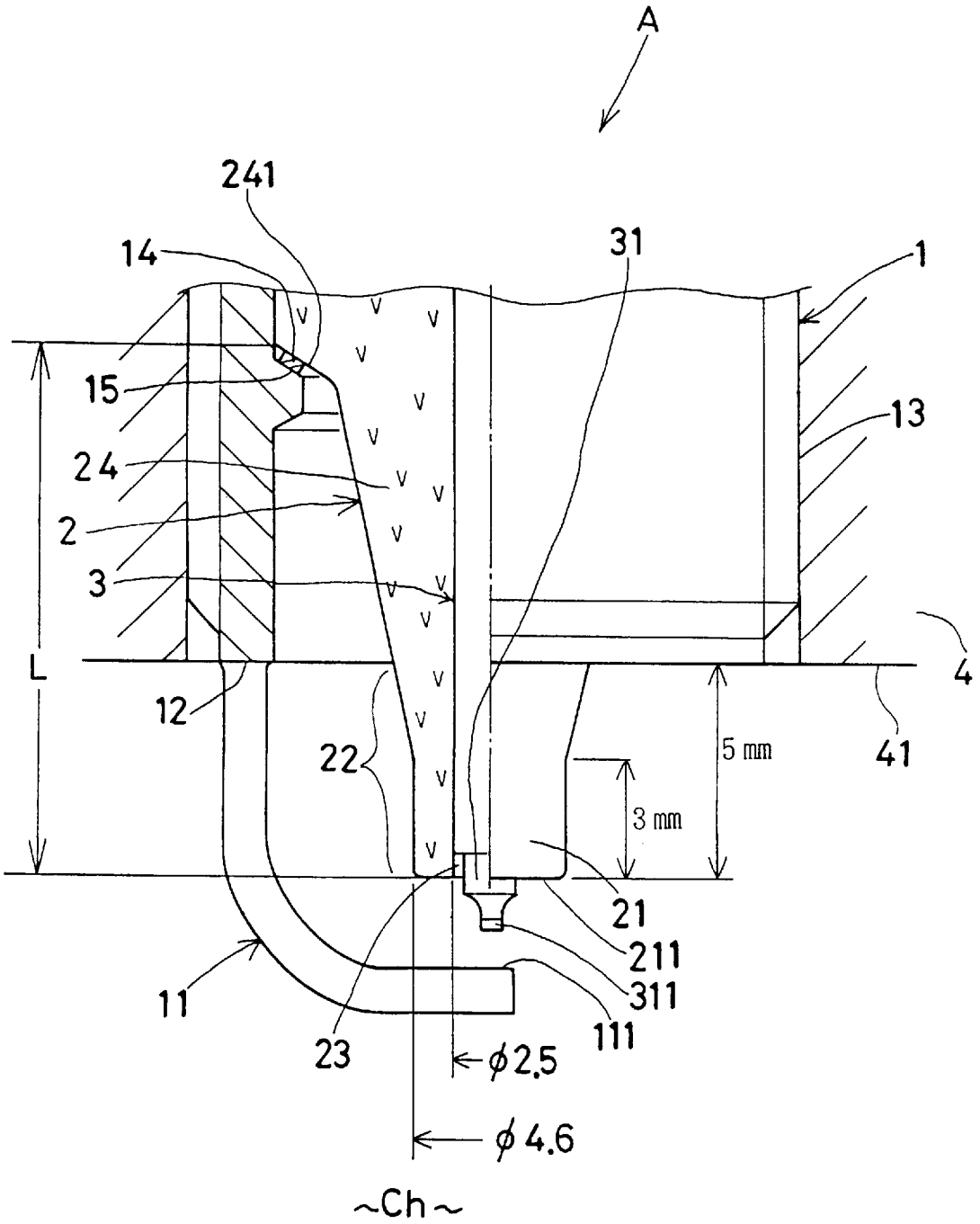
FIG. 1 is a longitudinal cross sectional view of a main portion of a spark plug when mounted on an Internal combustion engine according to a first embodiment of the invention.
Figure 1A:
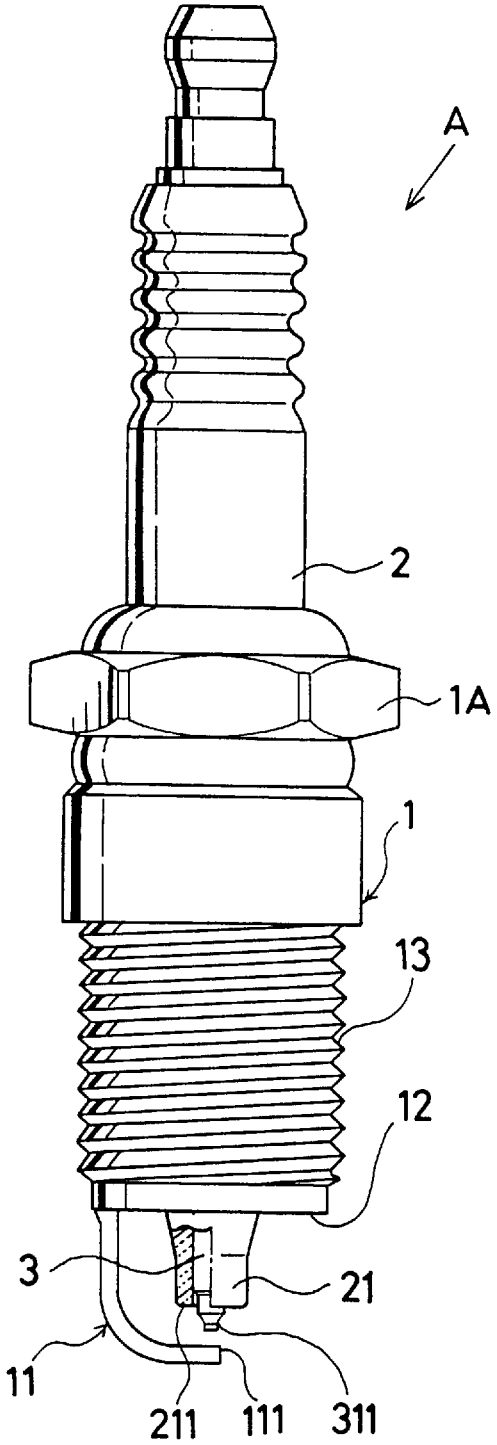
FIG. 1*a* is an elevational view of the spark plug.

Referring to FIGS. 1 and 1*a* which shows a spark plug which is to be mounted on a cylinder head 4 of an internal combustion engine via a gasket (not shown) according to a first embodiment of the invention, the spark plug (A) has a cylindrical metal shell 1 whose front end 12 has a ground electrode 11 and an insulator 2 fixedly supported within the metal shell 1. A front end 22 of the insulator 2 includes an equally diameter-reduced portion 21 so that the front end 22 extends by 5.0 mm from the front end 12 of the metal shell 1. The insulator 2 also has an axial bore 23 (2.5 mm in dia.) in which a center electrode 3 is firmly placed with its front end 31 extends beyond a front end surface 211 of the equally diameter-reduced portion 21 of the insulator 2 so as to release spark discharges against the ground electrode 11.

The metal shell 1 is made of a low carbon steel so that the ground electrode 11 is welded to the front end 12 of the metal shell 1. There is provided a threaded portion 13 (M14) at an outer surface of a forward area of the metal shell 1.

The insulator 2 is made of a ceramic material with alumina as a main constituent. The insulator 2 is supported within the metal shell 1 by resting a shoulder seat 241 of an insulator nose 24 (14.0 mm in length (L)) on a stepped portion 15 of an inner wall of the metal shell 1 by way of a packing 14. Then, the insulator 2 is consolidated by caulking a rear end tail contiguous to a hex nut portion 1A.

It is to be observed that the length (L) of the insulator nose 24 may exceeds 14.0 mm, and the equally diameter-reduced portion 21 measures 3.0 mm in length, 4.6 mm in outer diameter and 1.05 mm in thickness.

The center electrode 3 forms a composite structure which is made of a nickel-based alloy (e.g., Inconel 600) and a thermally conductive copper core which is embedded in the nickel-based alloy. To a front end surface of the front end 31 of the center electrode 3, a noble metal tip 311 (1.0 mm in dia.) is bonded by means of a laser or resistance welding. By way of illustration, the noble metal tip 311 is made of Pt-based alloy containing 20% Ir.

The ground electrode 11 is made of a nickel-based alloy (e.g., Inconel 600), and formed substantially into L-shaped configuration. A front end of the ground electrode 11 is turned toward the front end 31 of the center electrode 3 to be in registration therewith so as to release the spark discharges through a spark gap (1.0 mm) across a firing portion 111 of the ground electrode 11 and the noble metal tip 311.

Upon mounting the spark plug (A) on the cylinder head of the internal combustion engine, the front end 12 of the metal shell a is generally in flush with or slightly inward from an inner wall 41 of a combustion chamber (Ch) of the internal combustion engine.

In this instance, the front end 12 of the metal shell 1 is substantially in flush with the inner wall 41 of a combustion chamber (Ch), and a front end surface 211 of the equally diameter-reduced portion 21 of the insulator 2 extends by 5.0 mm from the front end 12 (i.e., inner wall 41) of the metal shell 1 toward a central area of the combustion chamber (Ch). In this situation, an approach length is a linear dimension that the front end surface 211 of the equally diameter-reduced portion 21 extends from the front end 12 of the metal shell 1. An extension length is a linear dimension that the front end surface 211 of the equally diameter-reduced portion 21 extends from the inner wall 41 of the combustion chamber (Ch). Knowing the approach length from the extension length are important upon referring to subsequent FIGS. 5, 6 and 7.

It is further observed that the approach length from the front end surface 211 to the front end 12 of the metal shell 1 is at least 4.0 mm.

Figure 5:
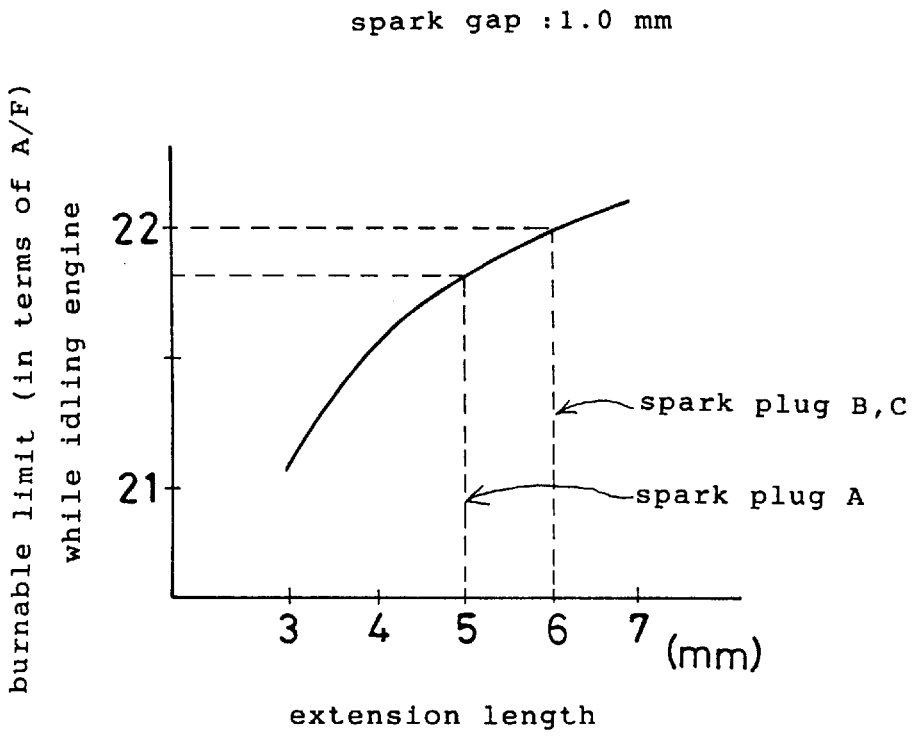
FIG. 5 is a graphical representation depicting how a burnable limit (in terms of A/F) changes depending on an extension length in which a front end of an insulator extends toward a combustion chamber from its inner wall.
Figure 6:
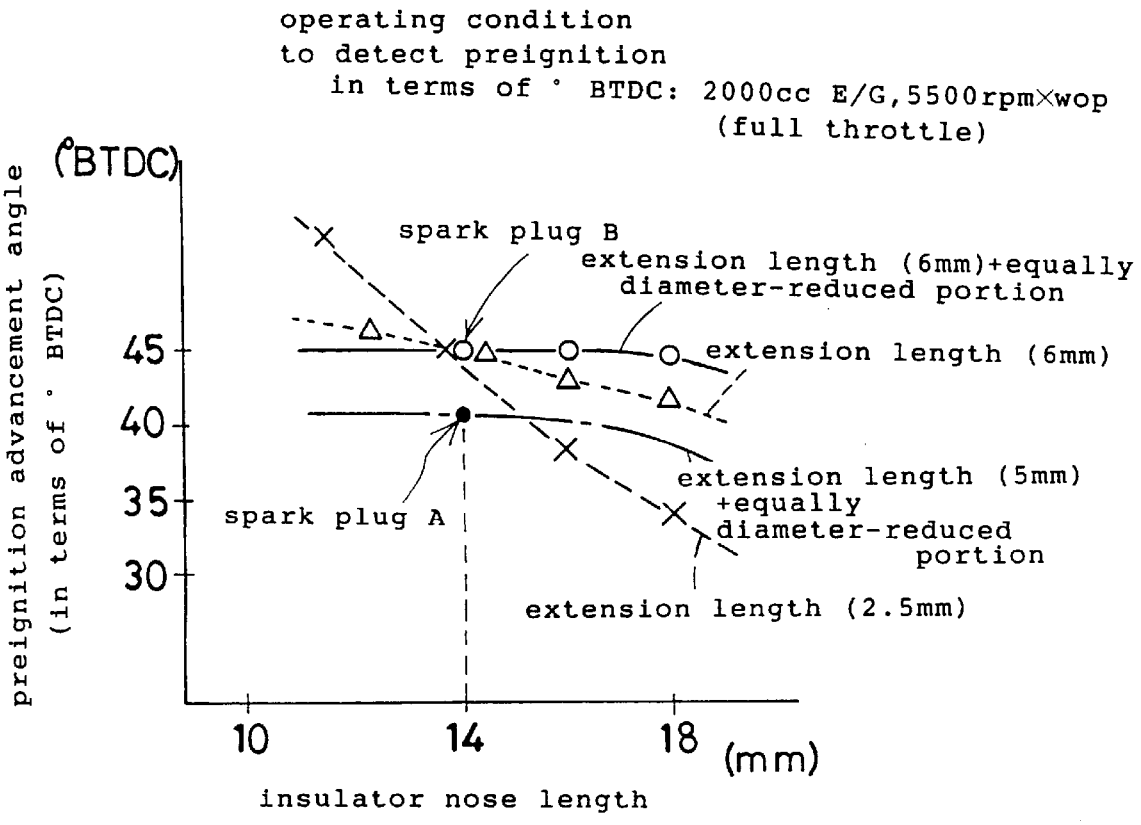
FIG. 6 is a graphical representation depicting a relationship between an insulator nose length and a preignition advancement angle (in terms of *BTDC) in spark plugs of different structure.

With the dimensional relationship thus arranged, it is possible to set the firing portion in an optimal location within the combustion chamber (Ch) so as to ensure a good ignitability as shown at a burnable limit (in terms of A/F) in FIG. 5.

Figure 7:
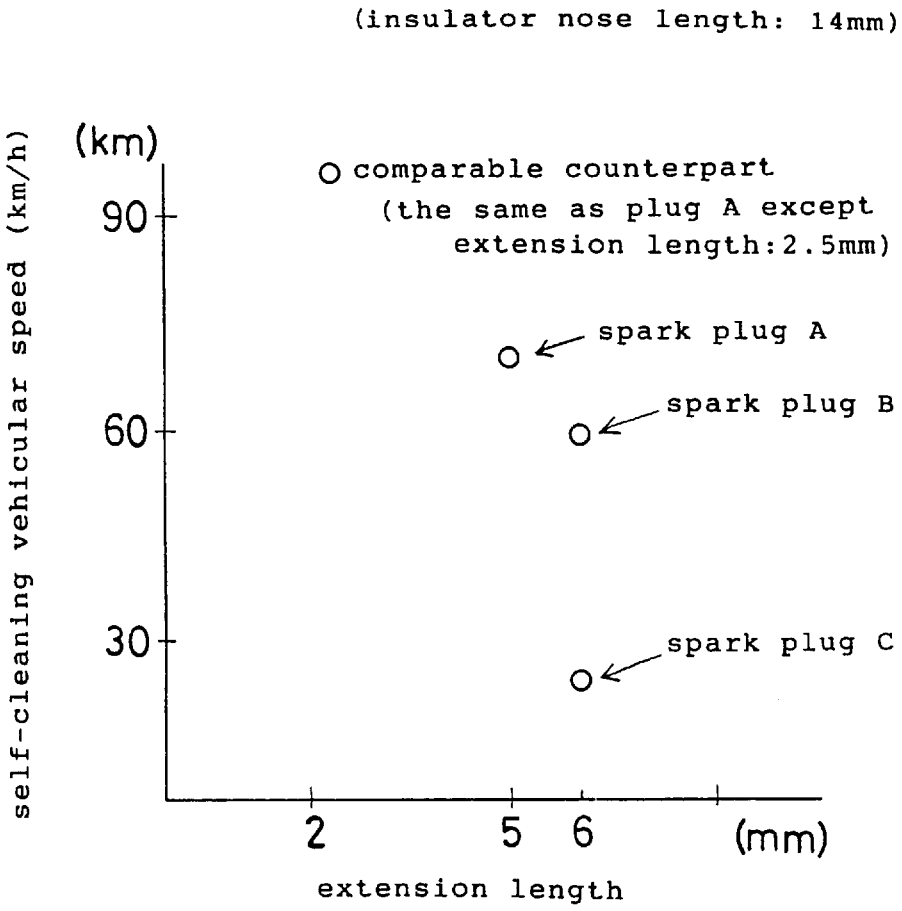
FIG. 7 is a graphical representation depicting a relationship between a vehicular speed and an extension length in which a front end of an insulator extends toward a combustion chamber in spark plugs of different structure.

Due to the approach length determined to be 5.0 mm, it is possible to quicken the temperature rise of the equally diameter-reduced portion 21, and thereby burning away the carbon deposit to improve the carbon fouling resistant property as shown at (A) in FIG. 7 particularly when running the engine at a low heat load. This means that it is possible to effect the self-cleaning action when running the engine at as slow as 65 km/h. With the thickness of the equally diameter-reduced portion 21 decreased to be 1.05 mm, it is possible to quickly cool the equally diameter-reduced portion 21 by the air-fuel mixture when running the engine at a high heat load. This imparts the heat resistant property to the insulator 2 to avoid an unfavorable preignition as exemplified at the dot-dash lines in FIG. 6 in which a preignition advancement angle is represented by an angle before a top dead center (*BTDC).

Figure 9:
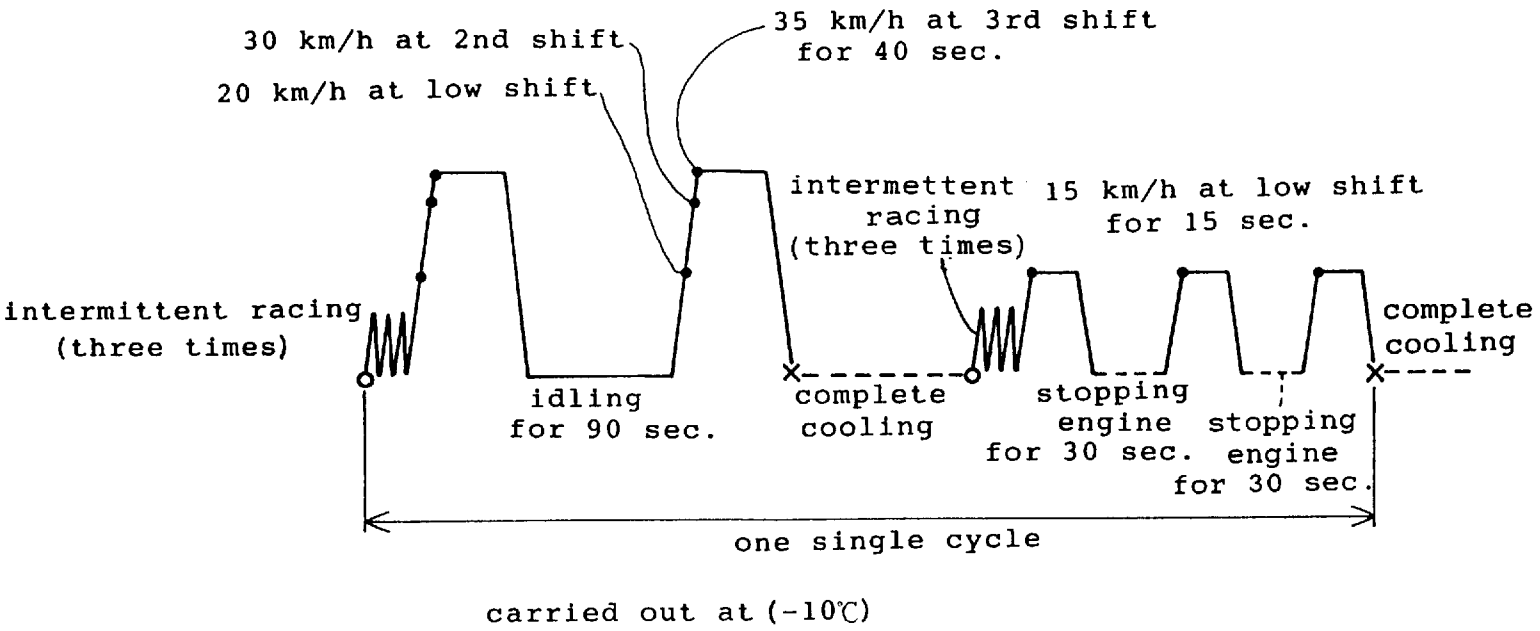
FIG. 9 is graphical representation depicting conditions imposed when carrying out a carbon fouling resistance experimentation test at the time of predelivering the spark plug product.

With the length (L) of the insulator nose 24 determined to be 14.0 mm, it is possible to diminish the insulation resistance drop to be evidenced by a carbon fouling resistance experimentation test carried out under the conditions of FIG. 9. It is to be noted that the addition of the equally diameter-reduced portion 21 forms the spark plug (A) into such an extention type structure as to improve the preignition resistance in which the heat-resistant property is unlikely to deteriorate when the insulator nose 24 Is lengthened.

Figure 2:
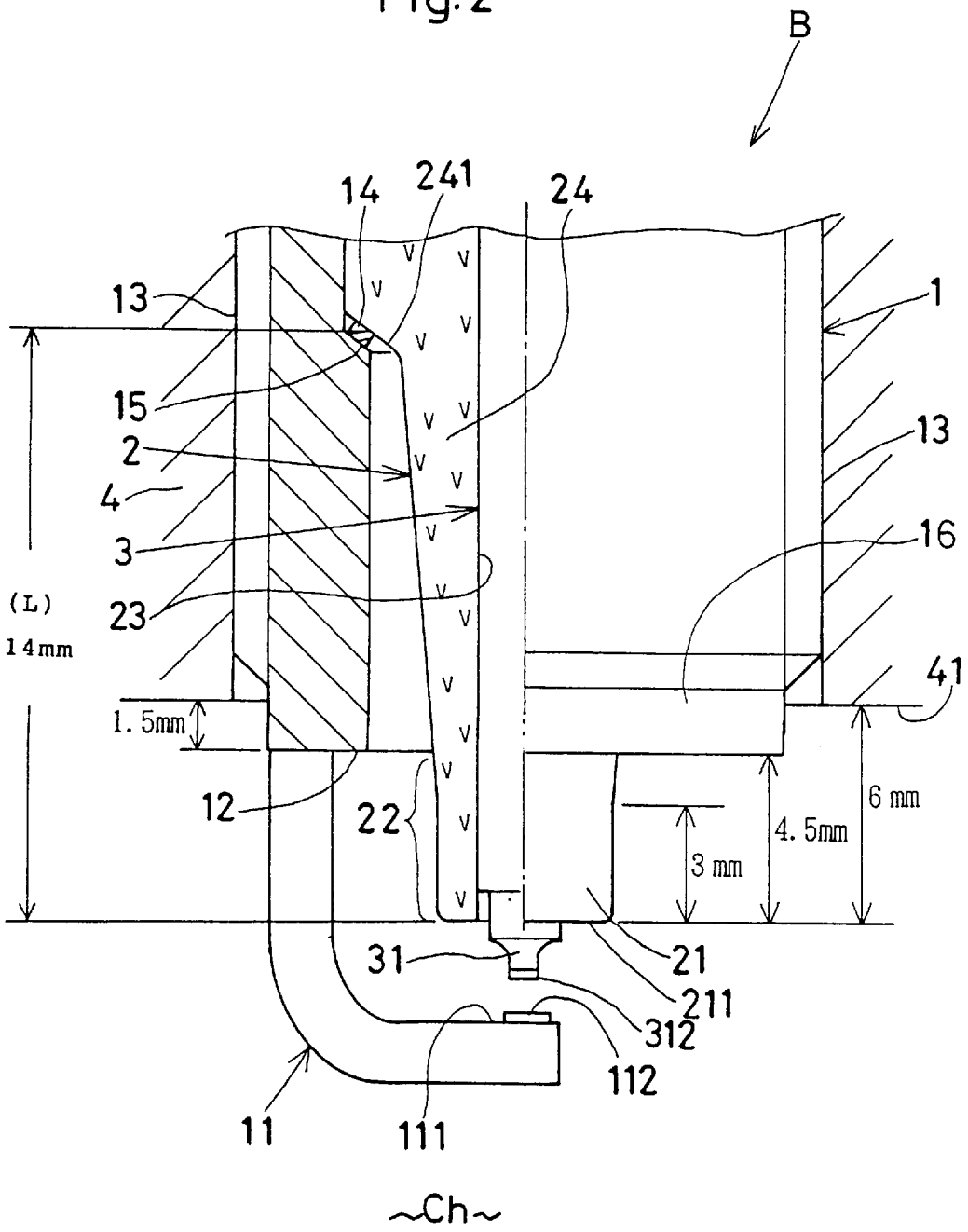
FIG. 2 is a longitudinal cross sectional view of a main portion of a spark plug when mounted on an internal combustion engine according to a second embodiment of the invention.

FIG. 2 shows a second embodiment of the invention in which a spark plug (B) has the same structure as the first embodiment of the invention except the following items.

The front end surface 211 of the insulator 2 extends by 6.0 mm (extension length) from the inner wall 41 toward a central area of the combustion chamber (Ch) of the internal combustion engine. As a cylindrical extension end, an EX shell 16 extends by 1.5 mm continuously from the threaded portion 13 of the metal shell 1 toward the combustion chamber (Ch). To a front open end 12 of the EX shell 16, the ground electrode 11 is bonded by a welding procedure. In this situation, the front open end 12 of the EX shell 16 is designated by the same numeral as the front end 12 of the metal shell 1 because the former is substantially equivalent structurally to the latter.

To the firing portion 111 of the ground electrode 11 turned to face the front end 31 of the center electrode 3, a noble metal tip 112 (1.0 mm in dia.) is laser welded to release the spark discharges through a spark gap (1.0 mm ) across the noble metal tip 112 of the ground electrode 11 and the noble metal tip 312 of the center electrode 3. The noble metal tip 112 is substantially the same as that provided on the center electrode 3.

In this instance, the front end surface 211 of the equally diameter-reduced portion 21 extends by 4.5 mm (approach length) from the front end 12 of the metal shell 1 toward the central area of the combustion chamber (Ch) since the EX shell 16 extends by 1.5 mm toward the combustion chamber (Ch).

With the dimensional relationship thus arranged, it is possible to set the firing portion in an optimal location within the combustion chamber (Ch) so as to ensure a good ignitability as shown at a burnable limit (in terms of A/F) in FIG. 5.

Due to the approach length determined to be 4.5 mm (6.0 mm in terms of extension length), it is possible to quicken the temperature rise of the equally diameter-reduced portion 21, thus burning away the carbon deposit to improve the carbon fouling resistant property as shown at (B) in FIG. 7 particularly when running the engine at a low heat load. This means that it is possible to effect the self-cleaning action when running the engine at as slow as 60 km/h. With the thickness of the equally diameter-reduced portion 21 decreased to be 1.05 mm, it is possible to quickly cool the equally diameter-reduced portion 21 by streams of the air-fuel mixture when running the engine at a high heat load. This imparts the good heat resistant property to the insulator 2 to avoid an unfavorable preignition as exemplified at the broken lines in FIG. 6.

Further, with the EX shell 16 protracted into the combustion chamber (Ch), it is possible to dimensionally shorten an entire length of the ground electrode 11 so as to avoid the ground electrode 11 from being inadvertently broken or excessively heated.

Additionally, with the length (L) of the insulator nose 24 determined to be 14.0 mm, it is possible to diminish the insulation resistance drop to be evidenced by a carbon fouling resistance experimentation test carried out under the conditions of FIG. 9. It is to be noted that the addition of the equally diameter-reduced portion 21 forms the spark plug (B) into such an extention type structure as to improve the preignition resistance in which the heat-resistant property is unlikely to drop when the insulator nose 24 is lengthened.

Figure 3:
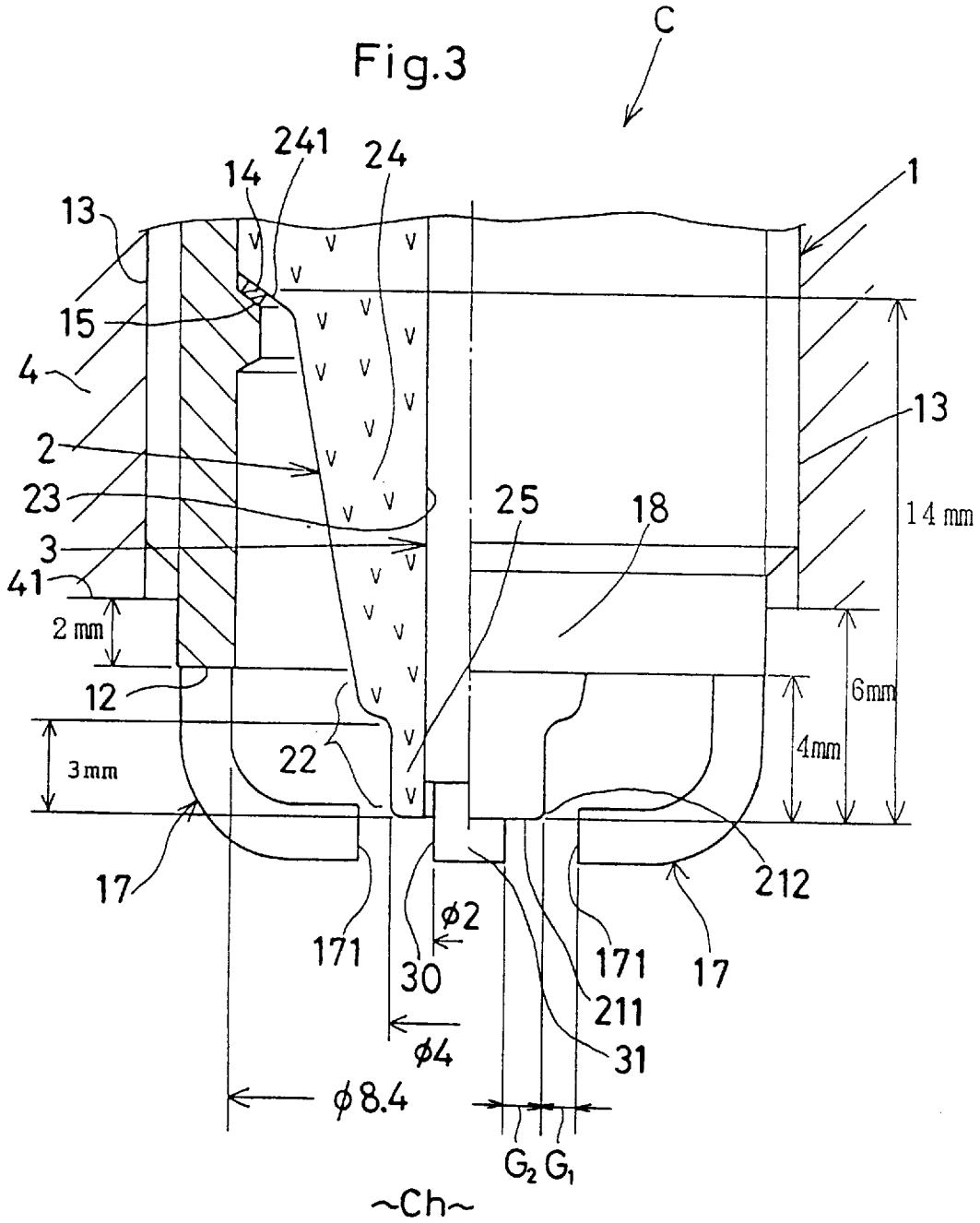
FIG. 3 is a longitudinal cross sectional view of a main portion of a semi-surface creeping discharge type spark plug when mounted on an internal combustion engine according to a third embodiment of the Invention.

FIG. 3 shows a third embodiment of the invention in which a semi-surface creeping discharge type spark plug (C) has the same structure as the first embodiment of the invention except the following items.

To the front end 12 of the metal shell 1, a pair of ground electrodes 17, 17 are connected. The front end 22 of the insulator 2 includes an equally diameter-reduced portion 25. and a front end surface 211 of the equally diameter-reduced portion 25 extends by 6.0 mm as the extension length from the inner wall 41 of the combustion chamber (Ch). In this instance, the equally diameter-reduced portion 25 is 3.0 mm in length, 4.0 mm in outer diameter and 0.9 mm in thickness.

As a cylindrical extension end, an EX shell 18 extends by 2.0 mm consecutively from the threaded portion 13 of the metal shell 1 toward the combustion chamber (Ch). To the front open end 12 of the EX shell 18, the ground electrodes 17, 17 are bonded by means of a welding procedure. In this situation, the front open end 12 of the EX shell 18 is designated by the same numeral as the front end 12 of the metal shell 1 because the former is substantially equivalent structurally to the latter.

Since the EX shell 18 extends by 2.0 mm inward, the front end surface 211 of the equally diameter-reduced portion 25 extends by 4.0 mm (approach length) resultantly from the front end 12 of the metal shell 1.

The center electrode 3 is the same as the first embodiment of the invention. The front end 31 of the center electrode 3 is 2.0 mm in diameter.

Each of front firing ends 171, 171 of the ground electrodes 17, 17 is turned to face an elevational side 30 of the front portion of the center electrode 3 so as to form an air discharge gap G1 and a creeping discharge gap G2 between the front firing ends 171, 171 and the elevational side 30 of the center electrode 3. Upon applying a high voltage across the center and ground electrodes, the creeping discharges are released along the front end surface 211 of the insulator 2 across the gap G2 while establishing the spark discharges through the gap G1 toward the front firing ends 171, 171 of the ground electrodes 17, 17.

Since the equally diameter-reduced portion 25 is provided on the front end 22 of the insulator 2, and the front end surface 211 extends by 4.0 mm (6.0 mm in terms of extension length) from the front end 12 of the metal shell 1 toward the central area of the combustion chambedr (Ch), it is possible to set the firing end in an optimal location within the combustion chamber (Ch) so as to ensure a good ignitability as shown at a burnable limit (in terms of A/F) in FIG. 5.

Due to the approach length determined to be 4.0 mm (6.0 mm in terms of extension length), it is possible to quicken the temperature rise of the equally diameter-reduced portion 25 to burn away the carbon deposit so as to improve the carbon fouling resistant property as shown at (C) in FIG. 7 when running the engine at a low heat load. This means that it is possible to effect the self-cleaning action when running the engine at as slow as 30 km/h. With the thickness of the equally diameter-reduced portion 25 decreased to be 0.9 mm, when the air-fuel mixture is injected in the combustion chamber (Ch), it quickly cools the equally diameter-reduced portion 25 to impart the good heat resistant property when running the engine at a high heat load.

With the creeping discharges released along the front end surface 211 of the insulator 2 across the creeping discharge gap G2 while establishing the spark discharges across the air discharge gap G1 toward the front firing ends 171, 171 of the ground electrodes 17, 17, it is possible to burn away the carbon deposit piled on the front end surface 211 of the insulator 2.

With the lengthened insulator nose 24 (14.0 mm in length), and the spark discharges occurring at the same location as when self-cleaning action is effected, it is possible to diminish the insulation resistance drop to be evidenced by a carbon fouling resistance experimentation test carried out under the conditions of FIG. 9 as described at the first embodiment of the invention. It is to be noted that the addition of the equally diameter-reduced portion 21 forms the surface-creeping type spark plug (C) into such an extention type structure as to attain a good heat resistant property when the insulator nose 24 is lengthened.

Further, with the EX shell 18 protracted into the combustion chamber (Ch), it is possible to dimensionally shorten the entire length of the ground electrodes 17, 17 so as to avoid them from inadvertently broken or excessively heated.

Figure 4:
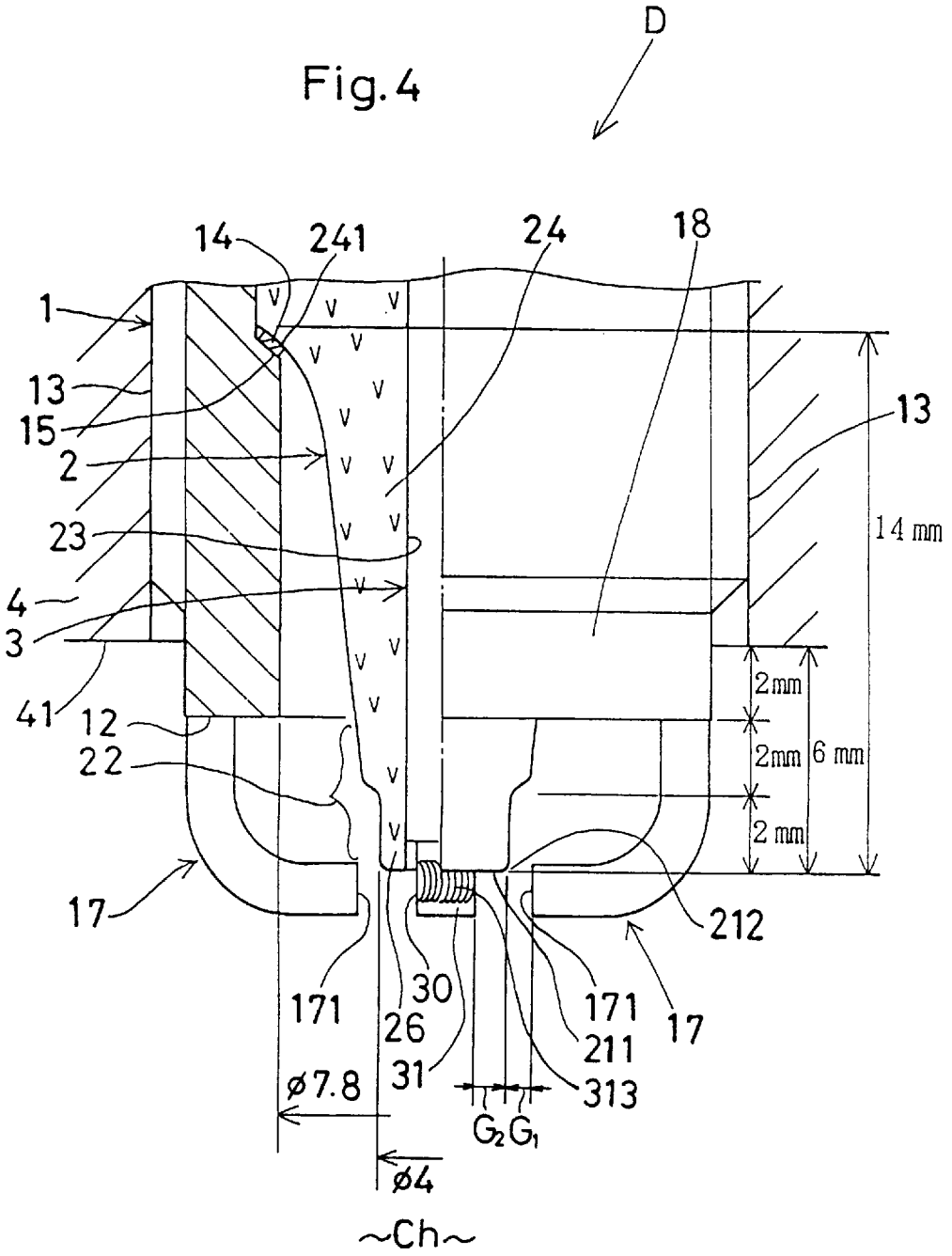
FIG. 4 is a longitudinal cross sectional view of a main portion of a semi-surface creeping discharge type spark plug when mounted on an internal combustion engine according to a fourth embodiment of the invention.

FIG. 4 shows a fourth embodiment of the invention in which a surface-creeping type spark plug (D) has the same structure as the third embodiment of the invention except the following items.

Namely, the front end 22 of the insulator 2 includes an equally diameter-reduced portion 26 which measures 2.0 mm in length, 4.0 mm in outer diameter and 0.9 mm in thickness. A forward portion of the metal shell 1 surrounding the insulator nose 24 is reduced to be 7.8 mm in inner diameter.

The front end of the composite type center electrode 3 has the elevational side 30 on which a noble metal alloy 313 is provided by means of a laser welding procedure. The noble metal alloy 313 is made of a Pt-based alloy containing 20% Ir.

The front firing ends 171, 171 of the ground electrodes 17, 17 are turned to face the noble metal alloy 313 so as to form the air discharge gap G1 and the creeping discharge gap G2 therebetween. Upon applying a high voltage across the center and ground electrodes, the creeping discharges are released along the front end surface 211 of the insulator 2 across the gap G2 while establishing the spark discharges through the air discharge gap G1 toward the firing ends 171, 171 of the ground electrodes 17, 17. It is to be observed that the air discharge gap G1 is less than 0.6 mm, preferably in the range of 0.2~0.6 mm.

Since the front end surface 211 of the equally diameter-reduced portion 26 extends by 4.0 mm from the front end 12 of the metal shell 1, it is possible to set the firing end in an optimal location within the combustion chamber (Ch) so as to ensure a good ignitability.

Due to the approach length determined to be 4.0 mm (6.0 mm in terms of extension length), it is possible to quicken the temperature rise of the equally diameter-reduced portion 26 to burn away the carbon deposit so as to improve the carbon fouling resistant property when running the engine at a low heat load. This means that it is possible to effect the self-cleaning action when running the engine at a low speed. With the thickness of the equally diameter-reduced portion 26 decreased to be 0.9 mm, when the air-fuel mixture is injected in the combustion chamber (Ch), it quickly cools the equally diameter-reduced portion 26 to impart a good heat resistant property when running the engine at a high heat load.

With the creeping discharges released along the front end surface 211 of the insulator 2 across the creeping discharge gap G2 while establishing the spark discharges across the air discharge gap G1 toward the firing ends 171, 171 of the ground electrodes 17, 17, it is possible to burn away the carbon deposit piled on the front end surface 211 of the insulator 2.

With the lengthened insulator nose 24 (14.0 mm in length), and the spark discharges occurring at the same location as when self-cleaning action is effected, it is possible to diminish the insulation resistance drop. As described in the third embodiment of the invention, with the EX shell 18 protracted into the combustion chamber (Ch), it is possible to dimensionally shorten the entire length of the ground electrodes 17, 17 so as to avoid then from inadvertently broken or excessively heated.

Although an outer diameter of the threaded portion is determined to be 14.0 mm, the forward portion of the metal shell 1 surrounding the insulator nose 24 is reduced to be 7.8 mm in inner diameter. This reduces a cubic volume of the forward portion of the metal shell 1, thus making it possible to substantially mitigate an entry of the carbon smoke into behind the metal shell 1.

Figure 8:
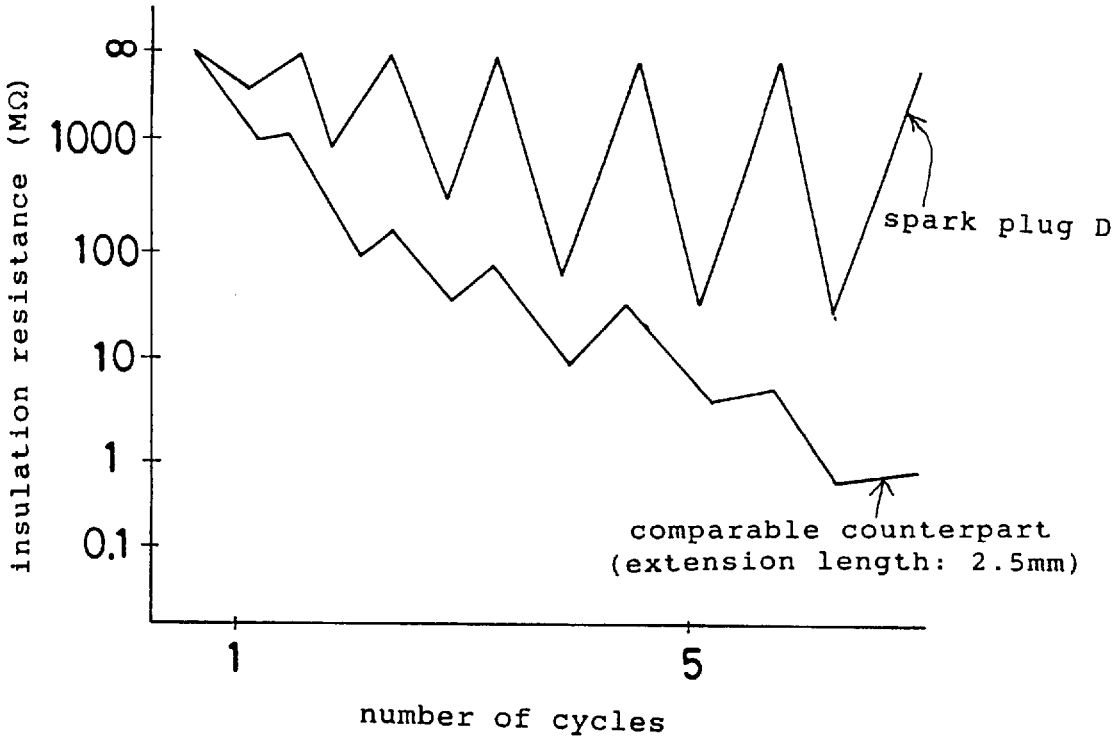
FIG. 8 a graphical representation depicting an experimental test result of a carbon fouling at the time of predelivering the spark plug product according to a fourth embodiment of the invention.

With the structure of the surface-creeping type spark plug (D), it is possible to ensure a good carbon fouling resistant proprty with a minimum insulation resistance drop as exemplified by a graphical representation of FIG. 8 which was obtained as a result of carrying out the fouling resistant experimentation test under the conditions of FIG. 9. In the semi-surface creeping discharge type spark plug (D), the addition of the equally diameter-reduced portion 26 forms an extension type spark plug so that the lengthened insulator nose 24 has a singnificantly small affect on a good heat resistance.

It is to be appreciated that a noble metal tip may be additionally provided on the firing end 171 of the ground electrode 17 of the spark plug (D) in the fourth embodiment of the invention.

While the invention has been described with reference to the specific embodiments, it is understood that this description is not to be construed in a limitting sense in as much as various modifications and additions to the specific embodiments may be made by skilled artisans without departing the scope of the invention.

We claim:

1. In a spark plug for use in an internal combustion engine including a cylindrical metal shell having a ground electrode; an insulator whose front end includes an equally diameter-reduced portion being fixedly supported within the metal shell with the front end of the insulator extended beyond a front end of the metal shell; the insulator having an axial bore in which a center electrode is placed to form an air discharge gap with the ground electrode:

the spark plug comprising:

the front end of the metal shell being adapted to be in flush with or somewhat inward into an inner wall of a combustion chamber of an internal combustion engine when the spark plug is mounted on a cylinder head of the internal combustion engine, the front end of the equally diameter-reduced portion of the insulator extending at least 4.0 mm from the end of the metal shell, wherein the equally diameter-reduced portion of the insulator is more than 1.0 mm in length, but less than 1.5 mm in thickness.

2. In a spark plug for use in an internal combustion engine including a cylindrical metal shell having a ground electrode; an insulator whose front end includes an equally diameter-reduced portion being fixedly supported within the metal shell with the front end of the insulator extended beyond a front end of the metal shell; the insulator having an axial bore in which a center electrode is placed to form an air discharge gap with the ground electrode:

the spark plug comprising:

the front end of the metal shell being adapted to be in flush with or somewhat inward into an inner wall of a combustion chamber of an internal combustion engine when the spark plug is mounted on a cylinder head of the internal combustion engine, the front end of the equally diameter-reduced portion of the insulator extending at least 4.0 mm from the end of the metal shell, wherein an outer surface of the metal shell has a threaded portion whose diameter is 14 mm, and the insulator has an insulator nose whose length is more than 14 mm.

3. In a spark plug for use in an internal combustion engine including a cylindrical metal shell having a ground electrode; an insulator whose front end includes an equally diameter-reduced Portion being fixedly supported within the metal shell with the front end of the insulator extended beyond a front end of the metal shell; the insulator having an axial bore in which a center electrode is placed to form an air discharge gap with the ground electrode:

the spark plug comprising:

the front end of the metal shell being adapted to be in flush with or somewhat inward into an inner wall of a combustion chamber of an internal combustion engine when the spark plug is mounted on a cylinder head of the internal combustion engine, the front end of the equally diameter-reduced portion of the insulator extending at least 4.0 mm from the end of the metal shell, wherein the metal shell has a cylindrical extension end which extends by more than 1.5 mm from the inner wall of the combustion chamber toward the central area of the combustion chamber.

4. A spark plug for use in an internal combustion engine including a cylindrical metal shell having a ground electrode; an insulator whose front end includes an equally diameter-reduced portion being fixedly supported within the metal shell with the front end of the insulator extended beyond a front end of the metal shell; the insulator having an axial bore in which a center electrode is placed to form an air discharge gap with the ground electrode:

the spark plug comprising:

the front end of the metal shell being adapted to be in flush with or somewhat inward into an inner wall of a combustion chamber of an internal combustion engine when the spark plug is mounted on a cylinder head of the internal combustion engine, the front end of the equally diameter-reduced portion of the insulator extending at least 4.0 mm from the end of the metal shell, wherein the spark plug forms a semi-surface creeping discharge type spark plug in which the center electrode forms a creeping discharge gap and an air discharge gap with an elevational side of the front end of the insulator so as to release creeping discharges across the creeping discharge gap along a front end surface of the insulator while releasing the spark discharge across the air discharge gap.

5. In a spark plug for use in an internal combustion engine including a cylindrical metal shell having a ground electrode; an insulator whose front end includes an equally diameter-reduced portion being fixedly supported within the metal shell with the front end of the insulator extended beyond a front end of the metal shell; the insulator having an axial bore in which a center electrode is placed to form an air discharge gap with the ground electrode:

the spark plug comprising:

the front end of the metal shell being adapted to be in flush with or somewhat inward into an inner wall of a combustion chamber of an internal combustion engine when the spark plug is mounted on a cylinder head of the internal combustion engine, the front end of the equally diameter-reduced portion of the insulator extending at least 4.0 mm from the end of the metal shell, wherein an outer surface of the metal shell has a threaded portion whose diameter is 14 mm, and an inner diameter of the metal shell portion which positions inside of the combustion chamber is less than 8 mm.

6. In a spark plug for use in an internal combustion engine including a cylindrical metal shell having a ground electrode; an insulator fixedly supported within the meal shell with a front end of the insulator extended beyond a front end of the metal shell; the insulator having an axial bore in which a center electrode is placed to form an air discharge gap with the ground electrode:

the spark plug comprising:

the front end of the metal shell being adapted to be substantially in flush with or somewhat inward into an inner wall of a combustion chamber of an internal combustion engine when the spark plug is mounted on a cylinder head of the internal combustion engine, the front end of the insulator extending at least 4.0 mm from the front end of the metal shell, wherein an outer surface of the metal shell has a threaded portion whose diameter is 14 mm, and the insulator has an insulator nose whose length is more than 14 mm.

7. In a spark plug for use in an internal combustion engine including a cylindrical metal shell having a ground electrode; an insulator fixedly supported within the meal shell with a front end of the insulator extended beyond a front end of the metal shell; the insulator having an axial bore in which a center electrode is placed to form an air discharge gap with the ground electrode:

the spark plug comprising:

the front end of the metal shell being adapted to be substantially in flush with or somewhat inward into an inner wall of a combustion chamber of an internal combustion engine when the spark plug is mounted on a cylinder head of the internal combustion engine, the front end of the insulator extending at least 4.0 mm from the front end of the metal shell, wherein the metal shell has a cylindrical extension end which extends by more than 1.5 mm from the inner wall of the combustion chamber toward the central area of the combustion chamber.

8. A spark plug for use in an internal combustion engine including a cylindrical metal shell having a ground electrode; an insulator fixedly supported within the meal shell with a front end of the insulator extended beyond a front end of the metal shell; the insulator having an axial bore in which a center electrode is placed to form an air discharge gap with the ground electrode:

the spark plug comprising:

the front end of the metal shell being adapted to be substantially in flush with or somewhat inward into an inner wall of a combustion chamber of an internal combustion engine when the spark plug is mounted on a cylinder head of the internal combustion engine, the front end of the insulator extending at least 4.0 mm from the front end of the metal shell, wherein the spark plug forms a semi-surface creeping discharge type spark plug in which the center electrode forms a creeping discharge gap and an air discharge gap with an elevational side of the front end of the insulator so as to release creeping discharges across the creeping discharge gap along a front end surface of the insulator while release the spark discharges across the air discharge gap.

9. In a spark plug for use in an internal combustion engine, including a cylindrical metal shell having a ground electrode; an insulator fixedly supported within the meal shell with a front end of the insulator extended beyond a front end of the metal shell; the insulator having an axial bore in which a center electrode is placed to form an air discharge gap with the ground electrode:

the spark plug comprising:

the front end of the metal shell being adapted to be substantially in flush with or somewhat inward into an inner wall of a combustion chamber of an internal combustion engine when the spark plug is mounted on a cylinder head of the internal combustion engine, the front end of the insulator extending at least 4.0 mm from the front end of the metal shell;

wherein an outer surface of the metal shell has a threaded portion whose diameter is 14 mm, and an inner diameter of the metal shell portion which positions inside of the combustion chamber is less than 8 mm.

* * * * *